US008949121B2

(12) United States Patent
Schandl et al.

(10) Patent No.: US 8,949,121 B2
(45) **Date of Patent: *Feb. 3, 2015**

(54) METHOD AND MEANS FOR ENCODING BACKGROUND NOISE INFORMATION

(75) Inventors: Stefan Schandl, Vienna (AT); Panji Setiawan, München (DE); Herve Taddei, Bonn (DE)

(73) Assignee: Unify GmbH & Co. KG, Munich (DE)

( * ) Notice: Subject to any disclaimer, the term of this patent is extended or adjusted under 35 U.S.C. 154(b) by 269 days.

This patent is subject to a terminal disclaimer.

(21) Appl. No.: 12/864,951

(22) PCT Filed: Feb. 2, 2009

(86) PCT No.: PCT/EP2009/051123

§ 371 (c)(1),
(2), (4) Date: Aug. 16, 2010

(87) PCT Pub. No.: WO2009/103610

PCT Pub. Date: Aug. 27, 2009

(65) Prior Publication Data

US 2011/0004471 A1 Jan. 6, 2011

(30) Foreign Application Priority Data

Feb. 19, 2008 (DE) ..... 10 2008 009 718

(51) Int. Cl.
*G10L 21/02* (2013.01)
*G10L 19/012* (2013.01)
*G10L 19/18* (2013.01)

(52) U.S. Cl.
CPC ..... *G10L 19/012* (2013.01); *G10L 19/18* (2013.01)
USPC ..... 704/226

(58) Field of Classification Search
USPC ..... 704/226
See application file for complete search history.

(56) References Cited

U.S. PATENT DOCUMENTS

| | | | | |
|---|---|---|---|---|
| 2007/0136055 | A1* | 6/2007 | Hetherington | 704/227 |
| 2008/0027716 | A1 | 1/2008 | Rajendran et al. | |
| 2008/0027717 | A1* | 1/2008 | Rajendran et al. | 704/210 |
| 2008/0059166 | A1* | 3/2008 | Ehara | 704/230 |
| 2008/0195383 | A1* | 8/2008 | Shlomot et al. | 704/205 |

FOREIGN PATENT DOCUMENTS

| | | | |
|---|---|---|---|
| CN | 1367918 | A | 9/2002 |
| EP | 1229520 | | 8/2002 |
| KR | 1020067009366 | | 5/2006 |
| KR | 20060111515 | A | 10/2006 |

(Continued)

OTHER PUBLICATIONS

Chan et al., Quality Enhancement of Narrowband CELP-Coded Speech via Wideband Harmonic Re-Synthesis, IEEE ICASSP 1997, pp. 1187-1190.*

(Continued)

*Primary Examiner* — Jakieda Jackson
(74) *Attorney, Agent, or Firm* — Buchana Ingersoll & Rooney PC

(57) ABSTRACT

The inventive method provides for an encoder in a voice codec to be designed such that after a particular idle time ("Idle Period") it recalculates the averaged energy and the autocorrelation function. Administrative points in the network inform the encoder about the idle time which has been set in the transmission network.

17 Claims, 1 Drawing Sheet

(56) References Cited

FOREIGN PATENT DOCUMENTS

| | | | |
|---|---|---|---|
| RU | 2187199 | | 8/2002 |
| RU | 2237296 | | 9/2004 |
| WO | 98/48524 | | 10/1998 |
| WO | 2005048620 | A1 | 5/2005 |
| WO | 2006136901 | A2 | 12/2006 |
| WO | 2008/016935 | | 2/2008 |

OTHER PUBLICATIONS

ITU-T G.729.1: G.729-based embedded variable bit-rate coder: An 8-32kbit/s scalable wideband coder bitstream interoperable with G.729, Dec. 18, 2007, pp. 1-91.*

International Preliminary Report on Patentability for PCT/EP2009/051123 (Forms PCT/IB/326, PCT/IB/373, PCT/ISA/237) (German).

International Search Report for PCT/EP2009/051123 dated Jun. 4, 2009 (Form PCT/ISA/210) (German and English Translation).

Written Opinion of the International Searching Authority dated Jun. 4, 2009 (Form PCT/ISA/237) (German).

Sollaud, "G.729.1 RTP Payload Format update: DTX support draft-ietf-avt-rfc4749-dtx-update-00", Feb. 8, 2008, pp. 1-7, The IETF Trust.

Setiawan et al., "On the ITU-T G.729.1 Silence Compression Scheme", Aug. 25-29, 2008, 16th European Signal Processing Conference (EUSIPCO 2008), Lausanne, Switzerland.

International Telecommunication Union, ITU-T, "Series G: Transmission Systems and Media, Digital Systems and Networks", Jun. 2008, pp. 1-36.

Written Opinion of the International Searching Authority for PCT/EP2009/051123 (Form PCT/ISA/237) (English Translation).

International Preliminary Report on Patentability for PCT/EP2009/051123 (Forms PCT/IB/373, PCT/ISA/237) (English Translation).

* cited by examiner

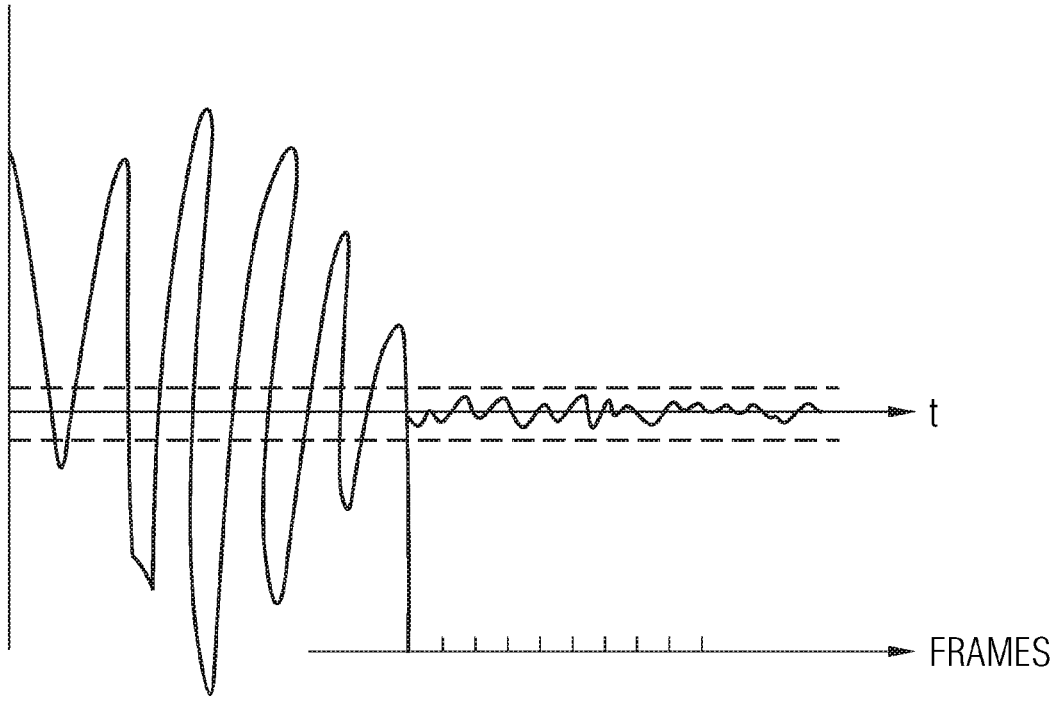
t
FRAMES

METHOD AND MEANS FOR ENCODING BACKGROUND NOISE INFORMATION

CROSS-REFERENCE TO RELATED APPLICATIONS

This application is the United States national phase under 35 U.S.C. §371 of PCT International Application No. PCT/EP2009/051123, filed on Feb. 2, 2009, and claiming priority to German Application No. 10 2008 009 718.7, filed Feb. 19, 2008. Those applications are incorporated by reference herein.

BACKGROUND OF THE INVENTION

1. Field of the Invention

Embodiments herein are in the field of encoding background noise information in voice signal encoding methods.

2. Description of the Related Art

Since the beginnings of telecommunication, a limitation of bandwidth for analog voice transmission has been designated for telephone calls. Voice transmission occurs at a limited range of frequencies, from 300 Hz to 3400 Hz.

Such a limited range of frequencies is also designated in many voice signal encoding methods for present-day digital telecommunications. To this end, prior to any encoding procedure, a delimitation of the analog signal's bandwidth is performed. In the process, a codec is used for coding and decoding, which, because of the described delimitation of its bandwidth between 300 Hz and 3400 Hz, is also referred to as a narrow band speech codec in what follows. The term codec is understood to mean both the coding requirement for digital coding of audio signals as well as the decoding requirement for decoding data with the goal of reconstructing the audio signal.

A well-known narrow band speech codec, for example, is the ITU-T-recommendation G.729. The transmission of a narrow band speech signal having a data rate of 8 kbits/s is provided using the coding requirement described therein.

Moreover, so-called wide band speech codecs, which provide for encoding in an expanded frequency range for the purpose of improving the auditory impression, are known. Such an expanded frequency range lies, for example, between a frequency of 50 Hz and 7000 Hz. A well-known wide band speech codec is, for example, the ITU-T recommendation G.729.EV.

Customarily, encoding methods for wide band speech codecs are configured to be scalable. Scalability here is taken to mean that the transmitted encoded data contain various delimited blocks, which contain the narrow band portion, the wide band portion, and/or the full band width of the encoded speech signal. Such a scalable configuration permits, on the one hand, a downward compatibility on the part of the recipient and, on the other hand, it affords a simple opportunity, in the case of limited data transmission capacities in the transmission channel, to effect an adjustment of the data rate on the side of the transmitter and the recipient and the size of transmitted data frames.

To reduce the data transmission rate by means of a codec, provision is customarily made for a compression of the data to be transmitted. A compression is achieved, for example, by encoding methods in which parameters for an excitation signal and filter parameters are determined for encoding the speech data. The filter parameters as well as the parameter that specifies the excitation signal are then transmitted to the recipient. There, with the aid of the codec, a synthetic speech signal is synthesized, which resembles the original speech signal as closely as possible insofar as any subjective auditory impression is concerned. With the aid of this method, which is also referred to as the "analysis by synthesis" method, the samples that are established and digitized are not transmitted themselves, but rather the parameters that were ascertained, which render a synthesis of the speech signal possible on the recipient's side.

A method for discontinuous transmission, which is also known in the field as DTX, affords an additional measure for the reduction of the data transmission rate. The fundamental goal of DTX is a reduction of the data transmission rate when there is a pause in speaking.

To this end, the sender employs speech pause recognition (Voice Activity Detection, VAD), which recognizes a speech pause if a certain signal level is not met.

Customarily, the recipient does not expect complete silence during a speech pause. On the contrary, complete silence would lead to annoyance on the recipient's part or even to the suspicion that the connection had been disrupted. For this reason, methods are employed to produce a so-called comfort noise.

A comfort noise is a noise synthesized to fill phases of silence on the recipient's side. The comfort noise serves to foster a subjective impression of a connection that continues to exist without utilizing the data transmission rate that is provided for the purpose of transmitting speech signals. In other words, less energy is expended for the sender to encode the noise than to encode the speech data. To synthesize the comfort noise in a manner still perceived by the recipient as realistic, data are transmitted at a far lower data rate. The data transmitted in the process are also referred to within the field as SID (Silence Insertion Description).

Present scalable encoding methods for wide band speech codecs do not currently provide any methods for discontinuous transmission.

In the state of the art, there are problems with any application of a discontinuous transmission (DTX) in conjunction with a comfort noise generator (CNG) on the recipient's side.

Currently known methods of discontinuous transmission provide for a transmission SID frame with updated parameters to characterize the background noise only if significant changes in the energy of the background noise are detected by the encoder during an inactive speech period (speech pause). This pertains to both narrow band (50 Hz to 4 kHz) and to wide band speech codecs, which support methods for discontinuous transmission. Customarily, in the decision to transmit a SID frame with updated parameters, an energy threshold that is specified in the decoder is used. This leads to the situation that if the defined energy threshold is not exceeded no SID frames are sent. On the part of the transmission network between recipient and sender, however, such suspension of the sending of SID frames is seen as the state at rest, or "Idle Channel." To ensure that a connection is maintained ("Connection Alive"), an additional exchange of data may be necessary to indicate that the connection is to be maintained.

A known, additionally provided data exchange occurs at present in that administrative points in the transmission network's network management call upon the sending node, i.e., the sending encoder, to send the most recently sent SID frame once more, in case the idle period to the most recently sent SID frame that elapsed is deemed to be too long for the connection in question. Parameters of the SID frame being sent again are not updated for such renewed transmission. The encoder, thus, does not perform any additional actions.

BRIEF SUMMARY OF THE INVENTION

Embodiments of the invention may provide an encoder of a speech code that after a predetermined idle period undertakes a new determination, or rather calculation of the parameter regarding the background noise, especially the average energy and the autocorrelation function. The aforementioned determination of the background noise parameters, in other words, corresponds to an encoding of the noise signal. Administrative points in the network inform the encoder regarding the idle time that has been set in the transmission network. Thus, the encoder determines the idle period, e.g. by querying administrative points in the transmission network. Such an inquiry is necessary only once if the idle period is saved by the encoder.

An adjustment of an interval in time for SID frames to be sent permits administrative points in the transmission network to compel the encoder to send an updated framework. This guarantees both an updating in favor of a better reconstruction of the background noise in the CNG as well as more reliably maintaining the connection.

A potential advantage of one embodiment is found in the fact that to decide whether updated background noise parameters in the form of an updated SID frame are to be sent, no comparison of the energy of the background noise signal with an energy threshold is necessary. Compared to the known methods, the method thus saves computer resources.

A further potential advantage resides in the fact that in some embodiments the adjusted duration between two SID frames agrees with the requirements of the transmission network in each case.

BRIEF DESCRIPTION OF THE FIGURES

FIG. 1 shows a speech burst, which at a certain time, t, falls below a certain signal level, threshold, which is represented in the drawing as a line of dashes.

DETAILED DESCRIPTION OF THE INVENTION

One advantageous embodiment of the invention provides for an SID structure (SID Bitstream Structure) in which the narrow band portion of the background noise information is separated from the wide band portion of the background noise information. A separate treatment of narrow band and wide band background noise information in a SID frame renders a separate encoding of the narrow band and wide band portion of the background noise possible and renders the processing transparent. This embodiment has the advantage, moreover, that the recipient can determine whether a comfort noise based upon the wide band portion of the transmitted SID frame, or based upon the narrow band portion should occur. This is particularly advantageous for the acoustic reception by the recipient in a situation in which the transmission rate for speech information frames was decreased such that only narrow band speech information is transferred. If, as in the current state of the art, namely, narrow band speech information is synthesized in conjunction with wide band noise, this is very irritating for the recipient. The aforementioned diminution of the transmission rate for speech information frames can, for example, be caused by a high utilization (congestion) of the network between sender and recipient. The much smaller SID frames are not affected by any such network bottleneck. Thus, for them, there is neither a constraint to reduce their data transmission rate nor their content.

One embodiment of the invention provides that the energy and auto-correlation function of the background noise are determined to ascertain the background noise parameters of the first, narrow band portion of the background noise. In the narrow band portion, averaging over a relatively long period of a speech pause is necessary, in practice, over a period of 100 ms, for example. The calculation variables that are used according to this form of embodiment comprise the energy (not the logarithmized energy) and the autocorrelation function.

At the beginning of a time segment, which is classified as inactive or as a speech pause, according to another advantageous embodiment of the invention, an additional hangover period is introduced. The newly introduced hangover period: DTX hangover period in what follows, compared to VAD (Voice Activity Detection) hangover period, serves an additional purpose, heretofore unknown.

While both types of hangover periods pursue the goal of identifying several frames as active speech frames and thus avoid a false classification at the end of a speech signal, the DTX hangover period has the additional goal of collecting information about the background noise.

A further embodiment provides for the attenuation of the second, wide band portion. The attenuation of the wide band portion plays a role in the attenuation of the entire energy portion in the wide band portion. This measure is necessary due to the fact that the generator for the synthesizing of the comfort noise in the decoder is not capable of producing the same noise properties as the original background noises in the encoder.

A further embodiment provides for the fact that a downstream de-emphasis post filter is applied to the entire background noise signal, i.e. the combination of the wide band and narrow band portion. The de-emphasis post filter leads to a de-emphasis of the energy and the higher frequency components. Since the averaging deforms the spectral envelope in a certain manner, this attenuation can, in an advantageous manner, contribute to the reduction of the distorting effect of a distorted wide band noise to a human recipient.

A further embodiment illustrated in greater detail in what follows by the drawing.

The FIGURE shows a representation, over time, of a transition from an input signal at a decoder from one that is classified as speech to one that is classified as background noise.

In the following, the technical background underlying the invention is described in greater detail, initially without reference to the drawing.

In the state of the art, problems exist with an application of the discontinuous transfer (DTX) in conjunction with a comfort generator on the recipient's side (CNG Comfort Noise Generator). During the DTX/CNG operation, the following considerations must be taken into account:

1 A suitable synthesis of the background noise or the comfort noise on the part of the CNG, which should be perceived by a listener on the recipient's side as realistic, is necessary. In the case of wide band speech codecs, thus, for example, speech codecs having a band width of frequencies between 50 Hz and 7 kHz, any synthesis of wide band noise is regarded as a deterioration. Beyond that, the character or "the color" of the background noise on the decoder and encoder side is not always equal, so that present solutions, which provide for the formation of a mean of the energy and the spectral envelope cause a falsification of the original background information.

2 The DTX method transmits updated SID frames only if significant changes in the energy of the background noise are detected by the encoder during an inactive speech period (speaking pause). This pertains to both narrow band (50 Hz to 4 kHz) and wide band speech codecs, which support the DTX/CNG method. Customarily, an energy threshold plays a central role in the process. This leads to the situation that if a defined energy threshold is not exceeded, no SID frames are sent. However, on the part of the transmission network between the recipient and the sender, such a suspension of the transmission of SID frames is regarded as the state at rest, or "idle channel." To ensure maintenance of the connection ("Connection Alive"), an additional exchange of data may be necessary to indicate that the connection is to be maintained.

At the present time, the aforementioned problems are addressed as follows:

Re 1.: The information pertaining to the wide band portion is encoded in the SID frame. In the process, the averaged logarithmic energy and the averaged immittance spectral frequency (ISF) are used to describe the wide band background noise, e.g. in the speech codecs G.722.2 and AMR-WB. In the process, no provision is made for separate treatment of a lower portion and an upper portion of the wide band background noise. The narrow band speech code G.729 employs an averaged logarithmic energy and an averaged autocorrelation function. The averaging period for the energy and the averaging period for the autocorrelation function do not correspond.

Re 2.: Administrative points in the network management call upon the sending node, i.e., the sending encoder, to transmit the most recently transmitted SID frame once more, in case the "idle period" proves to be too long for the pertinent connection. The encoder, thus, performs no additional actions.

The inventive method provides for embodying the encoder in such a manner that after a specified given time, it recalculates the averaged energy and the autocorrelation function. Administrative points in the network inform the encoder in the process regarding the requisite idle time.

Additional embodiments for generating the SID frame are described in what follows.

A SID structure (SID Bitstream Structure) is synthesized, in which the narrow band portion of the background noise information is separated from the wide band portion of the background noise information. Separate treatment of narrow band and wide band background noise information in a SID frame enables a separate encoding of the narrow band and wide band portions of the background noise possible and makes the processing transparent.

In the narrow band portion, averaging over a relatively long period of a speech pause is necessary, in practice over a period of 100 ms, for example. The calculation variables that are used in the process comprise the energy (not the logarithmized energy) and the autocorrelation function. The autocorrelation function is used for a spectral presentation of the envelope. A total amplification factor can be compensated for by means of a combination of all amplification and averaging methods. The values for the autocorrelation function are normed (equally weighted) in each case by adding or by forming the mean. This pertains to all SID frames. A relatively long averaging of the narrow band portion leads to a smoothing of the narrow band energy and the spectral envelopes so that a sudden change of energy causes no appreciable impact upon the synthesizing of the comfort noise in the recipient. This same averaging period is used both for the energy and for averaging the spectral envelope after an initial SID frame is generated after an insertion of a speech signal (Speak Burst). This measure ensures a more consistent estimate of the narrow band background noise during a transition from a speech period to a speaking pause.

In the following, reference is made to the FIGURE. The FIGURE shows a speech burst, which at a certain time, t, falls below a certain signal level, threshold, which is represented in the drawing as a line of dashes. The ordinate is to be understood as a level or value of the signal's energy. In addition, on the sender's part, a speech pause recognition (Voice Activity Detection, VAD) is used, which recognizes a speech pause if the threshold is not met. The VAD method makes provision for a known hang over period, VAD-HO, in which active speech frames continue to be sent, and only after two frame lengths, customarily, does it change to a mode that provides for a generation of SID frames.

According to the embodiment of the invention described here, an additional hangover period, DTX-HO, is introduced. The new hangover period, DTX-HO follows the hangover period that has been known thus far, VAD-HO, which is used as a "Black Box." During this hangover period, DTX-HO, the signal that is processed in the encoder is still classified as a speech signal, whereas parallel to that, a determination of background noise parameters has already begun. The data rate of the speech encoding is already reduced, because no highly qualitative encoding is required at the beginning of a speech pause. Moreover, for the narrow band portion, a part of the hangover period is used to form the mean value of the first SID frame. The aforementioned remarks refer mainly to the last frames FRAMES within a hangover period DTX-HO, VAD-HO. The information from the first frames of the hangover period is, in contrast, mainly not used.

The newly introduced hangover period DTX-HO, compared to the hangover period, VAD-HO, which has been known thus far, and is motivated by needs of voice activity detection, serves a further goal that has not been heeded thus far. Whereas both types of hangover periods, DTX-HO, and VAD-HO, pursue the goal of identifying several frames as active speech frames and thus avoiding a false classification at the end of the speech signal, the DTX hangover period, DTX-HO has the additional purpose of gathering information about the background noise.

For avoiding a false classification at the end of a speech signal, the new hangover period, DTX-HO represents an additional assurance that after the termination of the hangover period DTX-HO, definitively a background noise and no speech signals are on the decoder input. In the case of any use heretofore of the known hangover period, VAD-HO, it could not be ruled out that the signal that was applied only had to do with background noises exclusively. In practice, during this hangover period VAD-HO, speech bursts could still occur. In other respects, the new hangover period DTX-HO serves the purpose of learning the background noise exclusively.

Regarding the selection of the duration of these hangover periods, DTX-HO, VAD-HO, and thus, the selection of the number of frames FRAMES, an advantageous adjustment is to be selected in such a manner, e.g. that a duration of two frames—cf. dashed axis FRAMES—is provided for the known hangover period, VAD-HO and a duration of five frames is provided for the new hangover period, DTX-HO.

An attenuation of energy is performed in the wide band portion. The attenuation of the wide band portion plays a role in the attenuation of the entire energy portion in the wide band portion. This measure is necessary due to the fact that the generator for the production (synthesis) of the comfort noise in the decoder is incapable of producing the same noise properties as the original background noises in the encoder.

A downstream de-emphasis post filter is used on the wide band speech signal that is emitted, i.e. on the combination of the wide and narrow band portion. This filtering attenuates higher frequency components for the most part. The "de-emphasis post filter" leads, moreover, to a de-emphasis of the energy and the higher frequency components. Since the averaging deforms the spectral envelope in a particular way, this attenuation can contribute to reducing the distorting effect of a distorted wide band noise upon a human recipient.

The invention claimed is:

1. A method for the generation of Silence Insertion Description ("SID") frames for a discontinuous transmission of background noise parameters via a transmission network, the method comprising:

producing first narrowband SID information of background noise for inclusion into a first SID frame as a first component of the first SID frame via at least one encoder device communicatively connected to the transmission network;

producing second wideband SID information of the background noise for inclusion into the first SID frame as a second component of the first SID frame via the at least one encoder device;

producing third SID information of the background noise for inclusion into the first SID frame as a third component of the first SID frame via the at least one encoder device;

forming the first SID frame to include the first component, the second component and the third component, the first, second and third components being in separate areas of the formed first SID frame;

analyzing, via the at least one encoder device, the background noise based on at least one of energy and frequency distribution during a phase that precedes transmission of the first SID frame;

transmitting the first SID frame via the transmission network in response to detecting one of:

(i) a change in a wideband component of the background noise is equal to or exceeds a predetermined threshold, (ii) an occurrence indicating that an update to the narrowband SID information is to be sent; and receiving, by a receiver side, the first SID frame; and determining, by the receiver side, whether comfort noise should be generated based on the first component of the first SID frame or whether comfort noise should be generated based on the second component of the first SID frame or whether comfort noise should be generated based on the third component of the first SID frame.

2. The method of claim 1 further comprising determining the background noise parameters of a narrowband portion of the background noise by determining an energy and autocorrection function of the background noise.

3. The method of claim 2 further comprising determining the background noise parameters of the narrowband portion at 100 millisecond increments.

4. The method of claim 1 further comprising determining background noise parameters during a hangover period in a transition from a signal categorized as speech to a signal categorized as background noise.

5. The method of claim 1 further comprising attenuating a wideband portion of the background noise.

6. The method of claim 1 further comprising filtering said background noise through a downstream de-emphasis post filter.

7. The method of claim 1 wherein the at least one encoder device recalculates an averaged energy and autocorrelation function after a predetermined amount of time.

8. The method of claim 1 wherein the creating of the SID frames occurs after a speech pause is recognized.

9. The method of claim 1 further comprising a decoder communicatively coupled to the transmission network generating comfort noise after receipt of the SID frames, receipt of the SID frames indicating a detected speech pause to the decoder.

10. The method of claim 1 wherein the SID frames for the discontinuous transmission of background noise parameters via the transmission network comprise a plurality of speech recognition frames defining a first hangover period and a plurality of discontinuous transfer ("DTX") frames defining a second hangover period to gather information about background noise to exclusively learn about the background noise and to indicate that no speech signals are present in the DTX frames defining the second hangover period;

the at least one encoder separately encoding a wideband portion and a narrowband portion of the background noise information of the SID frames to be at least some of the DTX frames of the second hangover period; and the second hangover period occurring after the first hangover period.

11. The method of claim 10 further comprising a decoder device communicatively coupled to the transmission network generating comfort noise in response to receiving at least one of the DTX frames.

12. The method of claim 11 wherein the DTX frames of the second hangover period is comprised of at least five frames and the frames of the first hangover period is comprised of at least two frames.

13. The method of claim 10 further comprising a decoder device communicatively coupled to the transmission network generating comfort noise in response to receiving the encoded narrowband portion of the background noise.

14. The method of claim 10 further comprising a decoder device communicatively coupled to the transmission network generating comfort noise in response to receiving the encoded wideband portion of the background noise.

15. The method of claim 1 further comprising:

initiating a hangover period in response to detecting a change in a speech pause; and wherein the producing of the narrowband SID information, producing of the third SID information, and producing of the wideband SID information occurs during a hangover period.

16. The method of claim 1 wherein the first component of the first SID frame has a first data length, the second component of the SID frame has a second data length and the third component of the first SID frame has a third data length, the first data length being greater than the third data length and the first data length also being smaller than the second data length.

17. The method of claim 16 wherein the first narrowband SID information is produced by encoding at a first bit rate, the second wideband SID information is produced by encoding at a second bit rate that is greater than the first bit rate, and the third SID information is produced by encoding at a third bit rate that is smaller than the second bit rate and is greater than the first bit rate.

* * * * *